US006266076B1

(12) United States Patent
Kerr et al.

(10) Patent No.: US 6,266,076 B1
(45) Date of Patent: Jul. 24, 2001

(54) VACUUM IMAGING DRUM WITH VACUUM LEVEL CONTROL

(75) Inventors: Roger S. Kerr, Brockport; John D. Gentzke, Rochester; David F. Dalfonso, Victor, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/387,583

(22) Filed: Aug. 31, 1999

(51) Int. Cl.[7] ..... B41J 11/00
(52) U.S. Cl. ..... 347/220
(58) Field of Search ..... 347/220, 262, 347/266, 218, 215; 346/138, 134; 271/277; 318/368

(56) References Cited

U.S. PATENT DOCUMENTS 5,268,708 12/1993 Harshbarger et al. ..... 340/134
6,014,162 * 1/2000 Kerr et al. ..... 347/262
6,078,156 * 6/1998 Spurr ..... 318/368

* cited by examiner

*Primary Examiner*—N. Le
*Assistant Examiner*—K. Feggins
(74) *Attorney, Agent, or Firm*—Nelson Adrian Blish

(57) ABSTRACT

The present invention is for an image processing apparatus (10) for writing images to a thermal print media (32). The image processing apparatus (10) comprises a vacuum imaging drum (300). A lead screw (252) moves printhead (500) relative to the vacuum imaging drum (300). A motor (258) rotates the vacuum imaging drum (300). A variable vacuum blower (224) supplies vacuum to an interior portion (304) of said vacuum imaging drum (300) which holds the thermal print media (32) on a surface of the drum. A controller (186) changes a speed of the vacuum blower (224) to vary the vacuum in the vacuum imaging drum (300) when the thermal media (32) is loaded or unloaded.

10 Claims, 9 Drawing Sheets

VACUUM IMAGING DRUM WITH VACUUM LEVEL CONTROL

FIELD OF THE INVENTION

This invention relates to a subsystem of an image processing apparatus of the lathe bed scanning type for creating an image on sheet media held on a vacuum imaging drum, and more specifically to loading and unloading sheets of media onto a vacuum imaging drum that revolves at high speeds.

BACKGROUND OF THE INVENTION

Pre-press color proofing is a procedure used by the printing industry for creating representative images of printed material without the high cost and time required to actually produce printing plates and set up a high-speed, high-volume, printing press to produce a single example of an intended image. These intended images may require several corrections and may need to be reproduced several times to satisfy customers requirements. By utilizing pre-press color proofing time and money can be saved.

One such commercially available image processing apparatus, disclosed in commonly assigned U.S. Pat. No. 5,268,708, describes image processing apparatus having half-tone color proofing capabilities. This image processing apparatus is arranged to form an intended image on a sheet of thermal print media by transferring dye from a sheet of dye donor material to the thermal print media by applying a sufficient amount of thermal energy to the dye donor material to form an intended image. This image processing apparatus is comprised of a material supply assembly or carousel; lathe bed scanning subsystem, which includes a lathe bed scanning frame, translation drive, translation stage member, and printhead; vacuum imaging drum; and thermal print media and dye donor material exit transports.

The operation of the image processing apparatus comprises metering a length of the thermal print media, in roll form, from the material assembly or carousel. The thermal print media is cut into sheets, transported to the vacuum imaging drum, registered, wrapped around, and secured on the vacuum imaging drum. A length of dye donor material, in roll form, is metered out of the material supply assembly or carousel, and cut into sheets. The dye donor material is transported to and wrapped around the vacuum imaging drum, such that it is superposed in the registration with the thermal print media.

After the dye donor material is secured to the periphery of the vacuum imaging drum, the scanning subsystem writes an image on the thermal print media as the thermal print media and the dye donor material is rotated past the printhead. The translation drive traverses the printhead and translation stage member axially along the vacuum imaging drum, in coordinated motion with the rotating vacuum imaging drum to produce the intended image on the thermal print media.

After the intended image has been written on the thermal print media, the dye donor material is removed from the vacuum imaging drum without disturbing the thermal print media that is beneath it. The dye donor material is transported out of the image processing apparatus by the dye donor material exit transport. Additional sheets of dye donor material are sequentially superposed with the thermal print media on the vacuum imaging drum, and imaged onto the thermal print media as described above until the intended image is completed. The completed image on the thermal print media is unloaded from the vacuum imaging drum and transported to an external holding tray on the image processing apparatus by the receiver sheet material exit transport.

The vacuum imaging drum is cylindrical in shape and includes a hollow interior portion. A plurality of holes extending through the drum, apply a vacuum from the interior of the vacuum imaging drum to maintain the thermal print media and dye donor material on the drum as the vacuum imaging drum rotates.

A DC motor stator is attached to the lathe bed scanning frame, encircling a armature to form a reversible, variable speed DC drive motor for the vacuum imaging drum. The opposite spindle is provided with a central vacuum opening, which is in alignment with a vacuum fitting with an external flange that is rigidly mounted to the lathe bed scanning frame. Vacuum fitting is connected to a high-volume vacuum blower which is capable of producing 50–60 inches of water (93.5–112.2 mm of mercury) at an air flow volume of 60–70 cfm (28.368–33.096 liters per second). The blower provides vacuum to the vacuum imaging drum to hold the thermal print media and the dye donor materials on the drum while the drum is rotating.

The task of loading and unloading the dye donor materials onto and off the vacuum imaging drum, requires precise positioning of thermal print media and the dye donor materials. The lead edge positioning of dye donor material must be accurately controlled during this process. Existing image processing apparatus designs, such as that disclosed in said commonly assigned U.S. patents, employs a multi-chambered vacuum imaging drum for such lead-edge control. One chamber applies vacuum which holds the lead edge of the dye donor material. Another chamber controls vacuum which holds the trail edge of the thermal print media to the vacuum imaging drum. With this arrangement, loading a sheet of thermal print media and the dye donor material requires that the image processing apparatus feed the lead edge of the thermal print media and dye donor material into position just past the vacuum ports controlled by the respective valved chamber. Then vacuum is applied, gripping the lead edge of the dye donor materials against the vacuum imaging drum surface.

Unloading the dye donor material or the thermal print media requires the removal of vacuum from these same chambers so that an edge of the thermal print media or the dye donor material are freed and project out from the surface of the vacuum imaging drum. The image processing apparatus then positions an articulating skive into the path of the free edge to lift the edge further and to feed the dye donor material, to a waste bin or an output tray.

Although the operation of prior art image processing apparatus is satisfactory, it is not without drawbacks. The donor and receiver media must be held tightly against the surface of the vacuum imaging drum to prevent irregular surface conditions caused by factors such as folds, creases, wrinkles, or trapped air. Such irregular surface conditions could adversely affect the imaging process, or cause the media to fly-off at high drum speeds causing damage to the image processing apparatus. To achieve a flat surface, considerable vacuum force is exerted.

Throughput, the number of intended images per hour, is limited by the vacuum imaging drum rotational speed. The faster the vacuum imaging drum rotates without centrifugal forces or increased air turbulence lifting the thermal print media and the dye donor material from the vacuum imaging drum, the faster the intended image can be printed on the thermal print media. Thus faster rotational speeds will increase the throughput of the image processing apparatus.

Existing image processing apparatus technology is limited by the rotational speeds. At high rotational speeds, speeds in excess of 1000 RPM, centrifugal forces and air turbulence can lift or separate the dye donor materials from the vacuum imaging drum surface if the dye donor material and thermal print media is not correctly positioned on the surface of the vacuum imaging drum. If the dye donor material and thermal print media separates from the vacuum imaging drum, it could cause a media jam within the image processing apparatus, resulting in the loss of the intended image output, or cause catastrophic damage to the image processing apparatus.

Vacuum is applied to the thermal print media and dye donor material by a set of vacuum holes and vacuum grooves in the surface of the vacuum imaging drum, one set of holes and grooves for the thermal print media and one set for the dye donor material. One way to prevent the increased air turbulence and centrifugal force from lifting or separating the dye donor material from the rotating vacuum imaging drum would be to add more vacuum holes or enlarge the diameter of the vacuum holes. This would, however, require an increase in the vacuum level in the interior of the vacuum imaging. While this would allow increased vacuum imaging drum speed, it creates a problem with the loading the thermal print media and dye donor material since the lead edge must slide over the first rows of vacuum holes and grooves without being attached prematurely. Also, removal of the thermal print media and dye donor material from a vacuum imaging drum with more vacuum holes or larger vacuum holes is more difficult.

SUMMARY OF THE INVENTION

It is the object of the present invention to use vacuum level control to apply greater vacuum to the media during imaging and reduced level of vacuum during loading and unloading of the media.

The present invention is directed to overcoming one or more of the problems set forth above. Briefly summarized, according to one aspect of the present invention an image processing apparatus for writing images to a thermal print media comprises a vacuum imaging drum. A lead screw moves a printhead relative to the vacuum imaging drum and a motor rotates the vacuum imaging drum. A variable vacuum blower supplies vacuum to an interior portion of the vacuum imaging drum, which holds the thermal print media on a surface of the drum. A controller changes a speed of the vacuum blower to vary the vacuum in the vacuum imaging drum when the thermal media is loaded or unloaded.

A vacuum level control on the vacuum imaging drum allows a higher vacuum level to be applied to the imaging drum which allows the drum to rotate at higher speeds while media is loaded, and applies a reduced vacuum level while loading and unloading the media. Without the vacuum level control the dye donor material and the thermal print media sheet material are limited to the amount of centrifugal force or increased air turbulence it can withstand before they separate or lift off from the vacuum imaging drum. Without reduced vacuum level to the imaging drum during loading, the media would be drawn down prematurely causing a registration problem, which could cause a possible fly off of the media or an overlap of the media causing imaging problems. Reduced vacuum level is also required to lift the lead edge of the media so it can be removed from the imaging drum by the skives. Without this lower vacuum level the lead edge of the media cannot be lifted high enough to reliably pick the media off the drum with the skives. By adding the vacuum level control the media can be properly loaded and unloaded at a low vacuum level and the rotational speed of the vacuum imaging drum can be increased to as high as 3000 rpm or higher, substantially increasing the throughput of the image processing apparatus.

An advantage of the present invention is increased throughput of the image processing apparatus by increasing the rotational speed of the vacuum imaging drum to speeds as high as 3000 rpm.

An additional advantage of the present invention is handling a wider range of media with different beam strengths and thickness.

Yet another advantage of the present invention if that it does not require clamping of the media which would change the mass of the vacuum imaging drum and possible distort the vacuum imaging drum at high rotational speeds.

The invention and its objects and advantages will become more apparent in the detailed description of the preferred embodiment presented below.

DETAILED DESCRIPTION OF THE INVENTION

Figure 1:
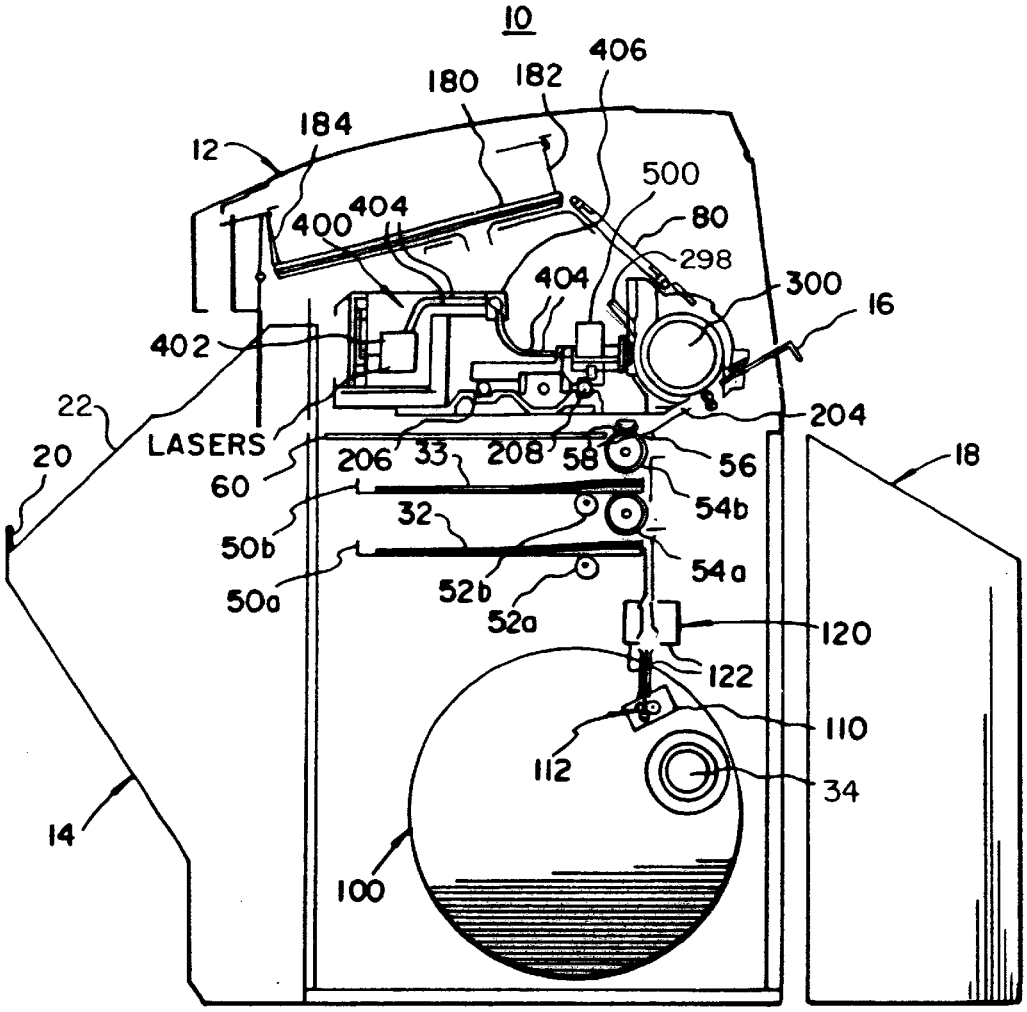
FIG. 1 is a side view in vertical cross section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12 which permits access to the two sheet material trays, lower sheet material tray 50*a* and upper sheet material tray 50*b*, which are positioned in the interior portion of the image processor housing 12, for supporting thermal print media 32. Only one of the sheet material trays will dispense the thermal print media 32 out of its sheet material tray to create an intended image thereon; the alternate sheet material tray either holds an alternative type of thermal print media 33 or functions as a back up sheet material tray. In this regard, the lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the upper sheet material tray 50*b* and ultimately the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing it onto the media staging tray 60. The media guide 56 is attached and hinged to the lathe bed scanning frame 202 (at shown in FIG. 2) at one end, and is uninhibited at its other end for permitting multiple positioning of the media guide 56. A low level vacuum is then applied to the vacuum imaging drum 300 by the vacuum blower 224.

Figure 2:
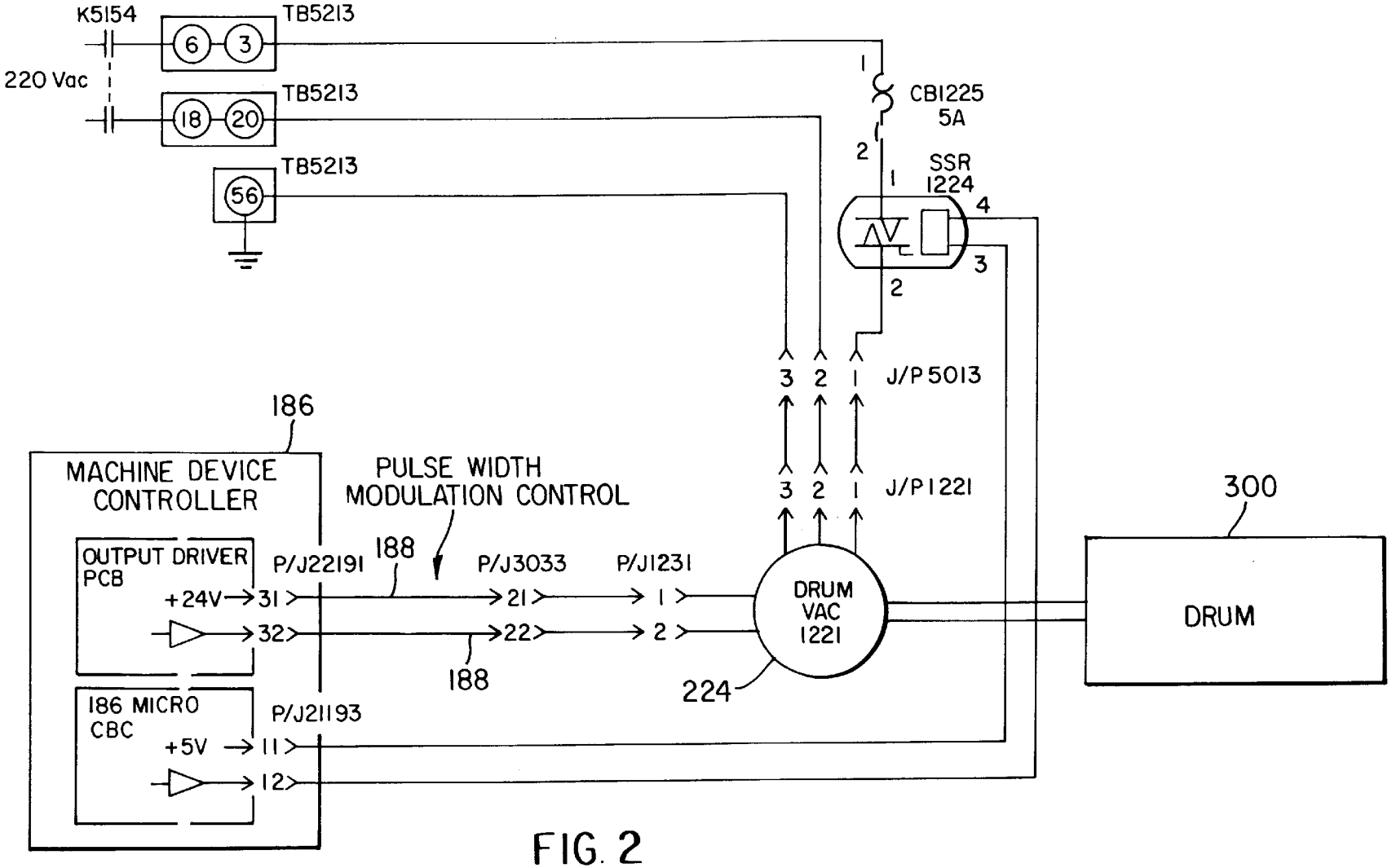
FIG. 2 is a schematic view of a controller for changing a vacuum level of an imaging drum according to the present invention.

The vacuum level in the drum 300 is controlled by the machine device controller 186, shown in FIG. 2, which controls vacuum levels using either a pulse width modulation signal or a DC voltage level over electrical lines 188. The media guide 56, shown in FIG. 1, then rotates its uninhibited end downward, as illustrated in the position shown, and the direction of rotation of the upper media roller 54*b* is reversed for moving the thermal print media 32 (shown in FIGS. 7*c*, 7*d*) resting on the media staging tray 60 under the pair of media guide rollers 58, upward through an entrance passageway 204 and around a rotatable vacuum imaging drum 300.

A roll media of dye donor roll material 34 is connected to the media carousel 100 in a lower portion of the image processor housing 12. Four roll media are used, but only one is shown for clarity. Each roll is a different color dye donor roll material, typically black, yellow, magenta and cyan. These dye donor roll materials 34 are cut into dye donor materials 36 and passed to the vacuum imaging drum 300 for transferring dyes to the thermal print media 32 resting thereon, which process is described in detail herein below. A media drive mechanism 110 is attached to each roll media of dye donor roll material 34, and includes three media drive rollers 112 through which the dye donor roll material 34 of interest is metered upwardly into a media knife assembly 120. After the dye donor roll material 34 reaches a predetermined position, the media drive rollers 112 cease driving the dye donor roll material 34 and the two media knife blades 122 positioned at the bottom portion of the media knife assembly 120 cut the dye donor roll material 34 into dye donor materials 36. The lower media roller 54*a* and the upper media roller 54*b* along with the media guide 56 then pass the dye donor material 36 onto the media staging tray 60.

The dye donor material is loaded on the vacuum imaging drum 300, with the vacuum level from the vacuum blower 224 still at a low level vacuum, and loaded on the drum in registration with the thermal print media 32 using the same process described above. After loading the dye donor material on the drum 300, the vacuum from the vacuum blower 224 is now increased to full vacuum level by changing the pulse width modulation signal to a continuous on signal or, alternatively, increasing the DC voltage level to a maximum level. In the preferred embodiment, the speed of the drum is increased after the vacuum level is increased. The dye donor material 36 rests atop the thermal print media 32 with a narrow gap between the two created by microbeads imbedded in the surface of the thermal print media 32.

A laser assembly 400 includes a quantity of laser diodes 402 in its interior, the laser diodes 402 are connected via fiber optic cables 404 to a distribution block 406 and ultimately to the printhead 500. The printhead 500 directs thermal energy received from the laser diodes 402 causing the dye donor material 36 to pass the desired color across the gap to the thermal print media 32. The printhead 500 is attached to a lead screw 250 via the lead screw drive nut 254, shown in FIG. 3, and drive coupling, not shown, which provides axial movement along the longitudinal axis of the vacuum imaging drum 300 for transferring the data to create the intended image onto the thermal print media 32.

During image writing, the vacuum imaging drum 300 rotates at a constant velocity, and the printhead 500 begins at one end of the thermal print media 32 and traverse the entire length of the thermal print media 32 for completing the transfer process for the particular dye donor material 36 resting on the thermal print media 32. After the printhead 500 has completed the transfer process, for the particular dye donor material 36 resting on the thermal print media 32, the vacuum level, from the vacuum blower 224, is reduced to assist in raising the lead edge of the dye donor material 36, which is then removed from the vacuum imaging drum 300 and transferred out the image processor housing 12 via a skive and donor ejection chute 16. The dye donor material 36 eventually comes to rest in a donor waste bin 18 for removal by the user. The process is then repeated for the other three roll media of dye donor roll materials 34.

After the color from all four sheets of the dye donor materials 36 have been transferred and the dye donor materials 36 have been removed from the vacuum imaging drum 300, the thermal print media 32 is removed from the vacuum imaging drum 300 at a low level vacuum, and transported via a transport mechanism 80 to a color binding assembly 180. The media entrance door 182 of the color binding assembly 180 is opened and the thermal print media 32 enters the color binding assembly 180. Door 182 shuts once the thermal print media 32 comes to rest in the color binding assembly 180. The color binding assembly 180 processes the thermal print media 32 for further binding the transferred colors on the thermal print media 32. After the color binding process has been completed, the media exit door 184 is opened and the thermal print media 32 with the intended image thereon passes out of the color binding assembly 180 and the image processor housing 12 and comes to rest against a media stop 20.

Figure 3:
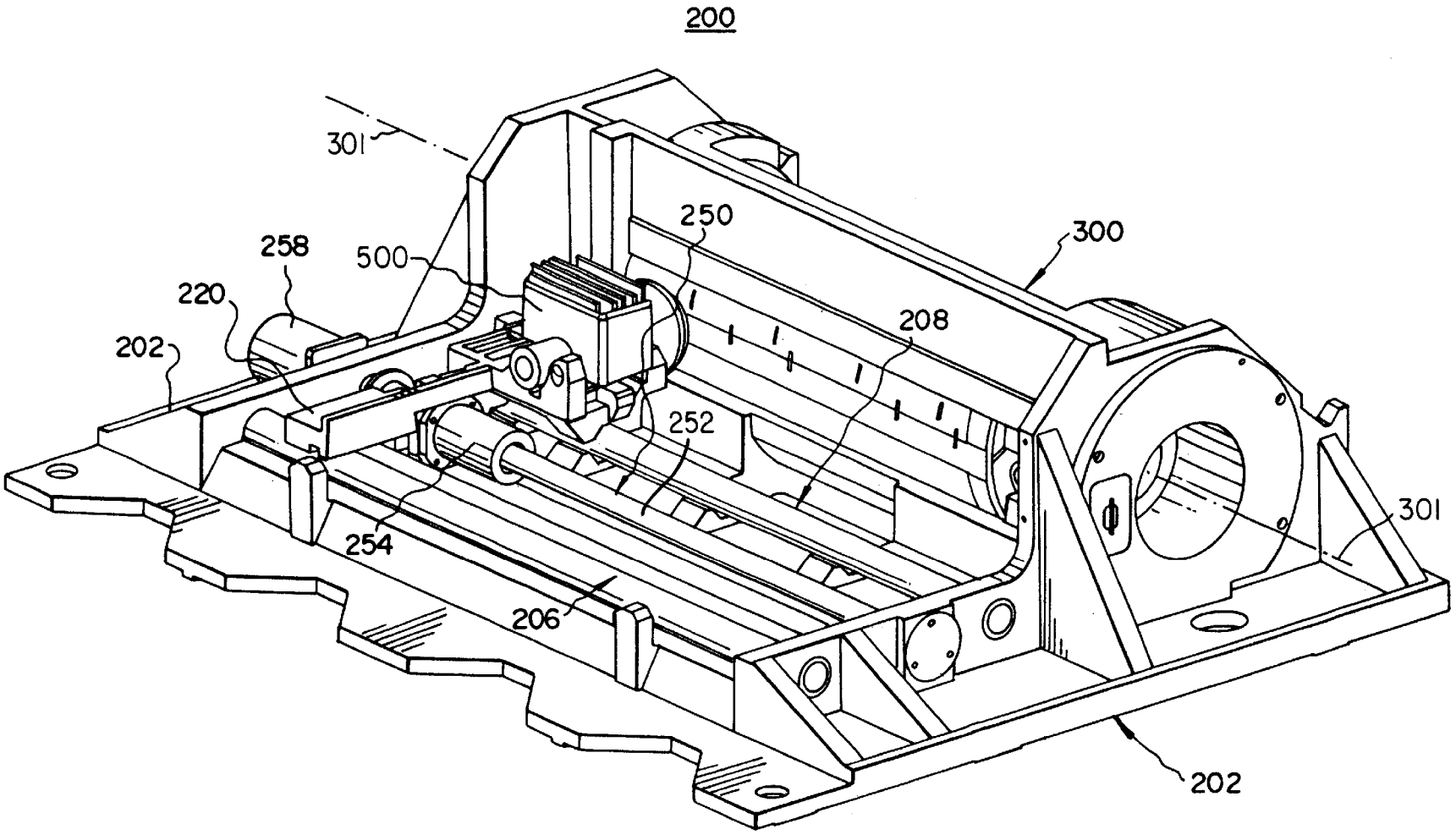
FIG. 3 is a perspective view of the lathe bed scanning subsystem or write engine of the present invention.

Referring to FIG. 3, there is illustrated a perspective view of the lathe bed scanning subsystem 200 which includes the vacuum imaging drum 300, printhead 500 and lead screw 250 assembled in the lathe bed scanning frame 202. The vacuum imaging drum 300 is mounted for rotation about an axis 301 in the lathe bed scanning frame 202. The printhead 500 is movable with respect to the vacuum imaging drum 300, and is arranged to direct a beam of light to the dye donor material 36. The beam of light from the printhead 500 for each laser diode 402 is modulated individually by modulated electronic signals from the image processing apparatus 10, which are representative of the shape and color of the original image, so that the color on the dye donor material 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The translation bearing rods 206 and 208 are sufficiently rigid so that they do not sag or distort between their mounting points and are arranged as parallel as possible with the axis 301 of the vacuum imaging drum 300 with the axis of the printhead 500 perpendicular to the axis 301 of the vacuum imaging drum 300 axis. The front translation bearing rod 208 locates the translation stage member 220 in the vertical and the horizontal directions with respect to axis 301 of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 4:
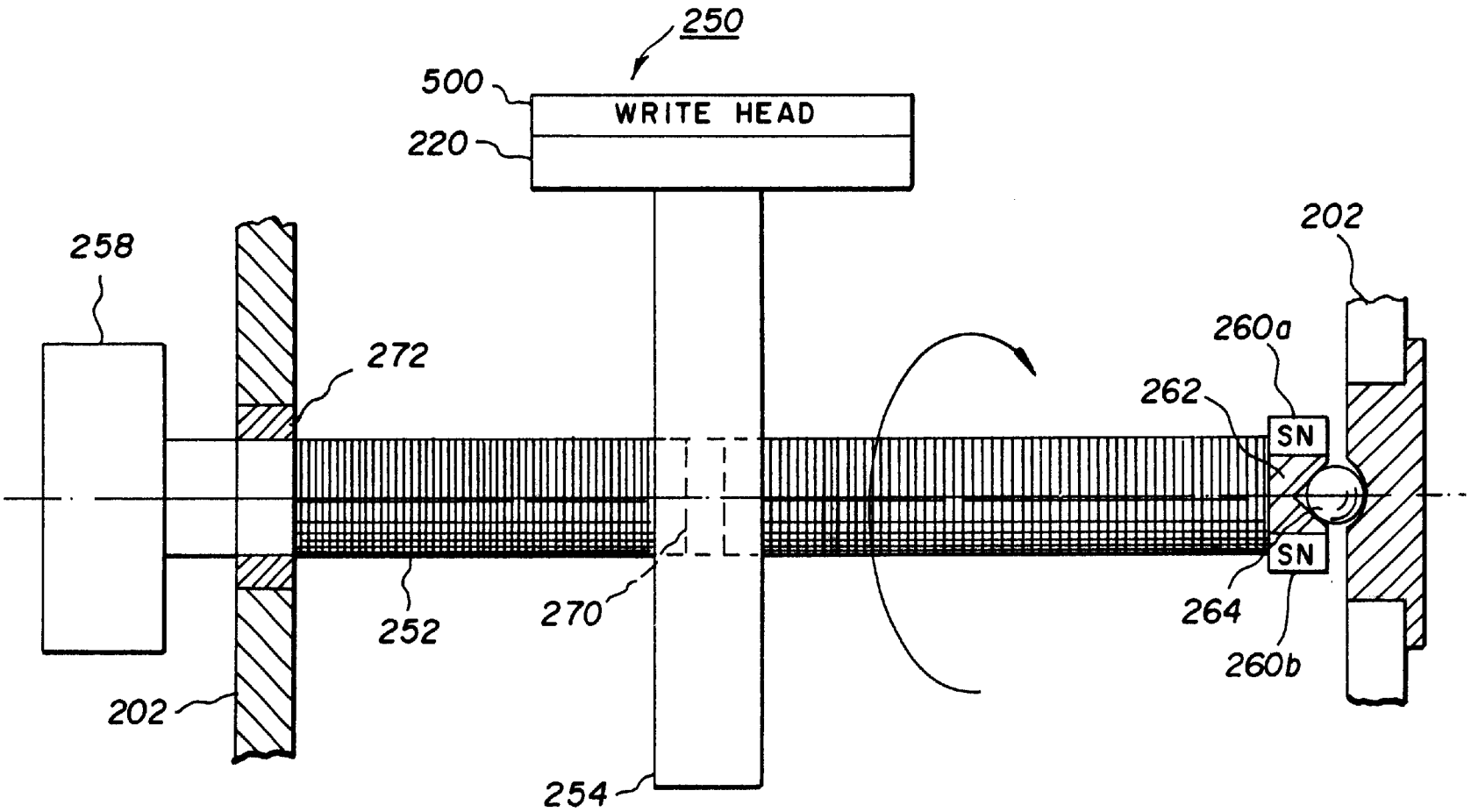
FIG. 4 is a top view in horizontal cross section, partially in phantom, of the lead screw of the present invention.

Referring to FIGS. 3 and 4, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 270 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through a drive coupling, not shown, and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As best illustrated in FIG. 4, an annular-shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262, part of the threaded shaft 252, rests in the hollowed-out portion of the annular-shaped axial load magnet 260*a*, and includes a generally V-shaped surface at the end for receiving a ball bearing 264.

In operation, linear drive motor 258 is energized and imparts rotation to the lead screw 250, as indicated by the arrows, causing the lead screw drive nut 254 to move axially along the threaded shaft 252. The annular-shaped axial load magnets 260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252 to rotate.

The printhead 500 travels in a path along the vacuum imaging drum 300, while being moved at a speed synchronous with the vacuum imaging drum 300 rotation and proportional to the width of the writing swath, not shown. The pattern that the printhead 500 transfers to the thermal print media 32 along the vacuum imaging drum 300, is a helix.

Figure 5:
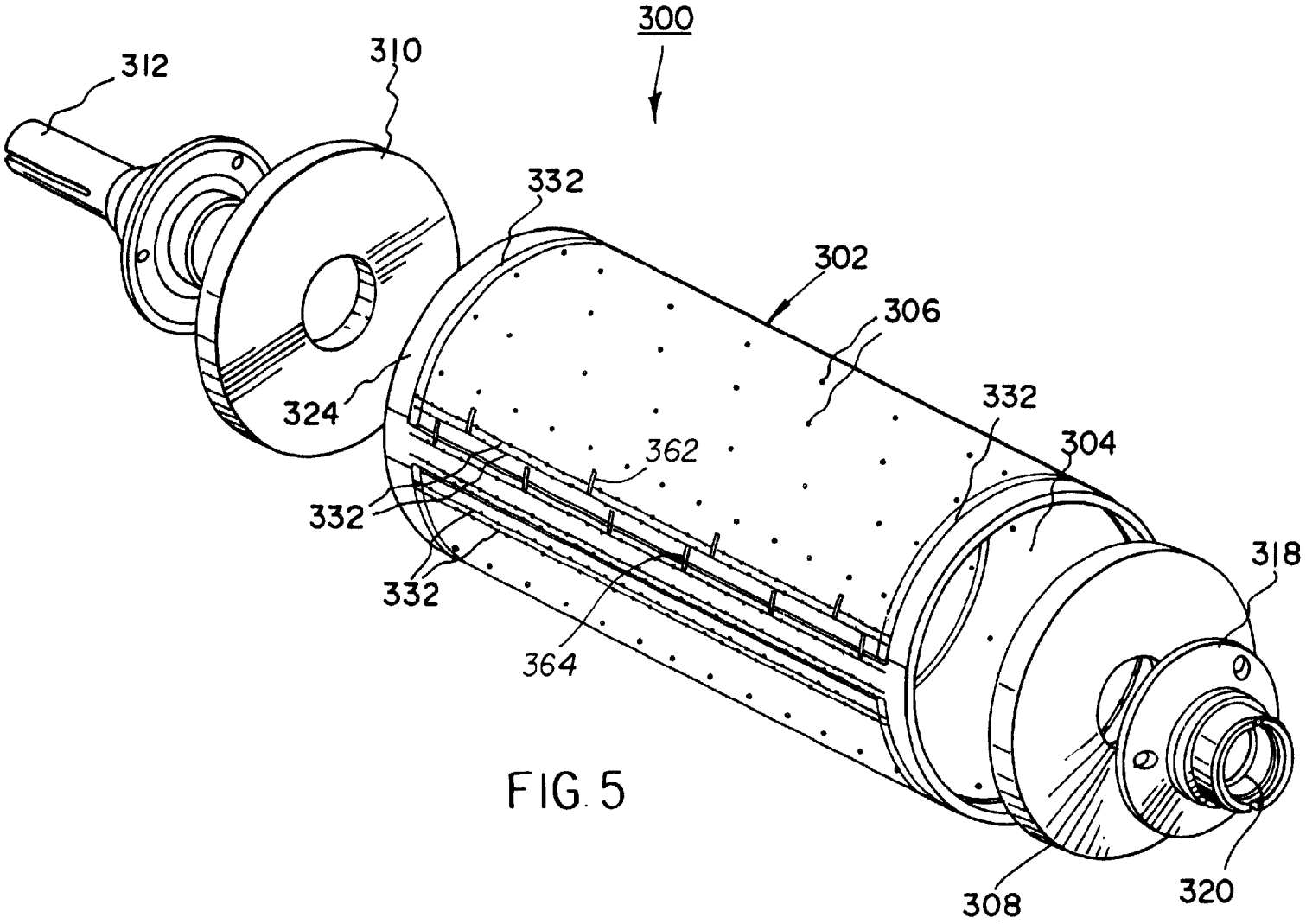
FIG. 5 is an exploded, perspective view of the vacuum imaging drum of the present invention.

FIG. 5 shows an exploded view of the vacuum imaging drum 300. The vacuum imaging drum 300 comprises a cylindrical shaped vacuum drum housing 302 that has a is generally hollowed-out interior portion 304, which may be manufactured from a length of extruded aluminum tubing and further is provided with a plurality of vacuum grooves 332 in the surface of the vacuum imaging drum 300 and vacuum holes 306 which extend through the vacuum drum housing 302 which allows a vacuum to be applied from the hollowed-out interior portion 304 of the vacuum imaging drum 300 for supporting and maintaining position of the thermal print media 32, and the dye donor material 36, as the vacuum imaging drum 300 rotates. Spaced along the interior of the vacuum drum housing 302 is a plurality of support rings.

The ends of the vacuum imaging drum 300 are closed by the vacuum end plate 308, and the drive end plate 310. The drive end plate 310 is provided with a centrally disposed drive spindle 312, which extends outwardly through a support bearing. The vacuum end plate 308 is provided with a centrally disposed vacuum spindle 318, which extends outwardly therefrom through another support bearing.

The drive spindle 312 is stepped down to receive a DC drive motor armature, not shown. A DC motor stator, not shown, is held by the late bed scanning frame member 202, encircling the DC drive motor armature to form a reversible, variable DC drive motor for the vacuum imaging drum 300. At the end of the drive spindle 312 a drum encoder, not shown, provides timing signals to the image processing apparatus 10, and controls the speed of the drum and timing of dye transfer.

The vacuum spindle 318 is provided with a central vacuum opening 320 which is in alignment with a vacuum fitting with an external flange which is rigidly mounted to the lathe bed scanning frame 202. The vacuum fitting has an extension, which extends within but is closely spaced from the vacuum spindle 318, thus forming a small clearance. With this configuration, a slight vacuum leak is provided between the outer diameter of the vacuum fitting and the inner diameter of the central vacuum opening 320 of the vacuum spindle 318. This assures that no contact exists between the vacuum fitting, not shown, and the vacuum imaging drum 300 which might impart uneven movement or jitters to the vacuum imaging drum 300 during its rotation.

The opposite end of the vacuum fitting is connected to a vacuum blower 224 which is capable of producing 50–60 inches of water (93.5–112.2 mm of mercury) at an air flow volume of 60–70 cfm (28.368–33.096 liters per second). And provides the vacuum to the vacuum imaging drum 300 supporting the various internal vacuum levels of the vacuum imaging drum 300 required during the loading, scanning and unloading of the thermal print media 32 and the dye donor materials 36 (shown in FIGS. 7*c* and 7*d*).

With no media loaded on the vacuum imaging drum 300 the internal vacuum level of the vacuum imaging drum 300 is approximately 10–15 inches of water (18.7–28.05 mm mercury). With just the thermal print media 32 loaded on the vacuum imaging drum 300 the internal vacuum level of the vacuum imaging drum 300 is approximately 20–25 inches of water (37.4–46.75 mm of mercury). This level is required such that when a dye donor material 36 is removed, the thermal print media 32 does not move otherwise color to color registration will not be able to be maintained. With both the thermal print media 32 and dye donor material 36 completely loaded on the vacuum imaging drum 300 the internal vacuum level of the vacuum imaging drum 300 is approximately 50–60 inches of water (93.5–112.2 mm of mercury) in this configuration. These levels can be maintained for this current configuration or varied for larger sheets of media or media with different beam strengths by the pulse width modulation signal or the DC voltage level from the machine device controller 186 to the vacuum blower 224 to allow for proper vacuum levels of vacuum for loading and unloading while being able to obtain the high level of vacuum required for the high RPM'S of the vacuum imaging drum 300 speed.

Referring to FIGS. 6*a*–6*d*, the vacuum imaging drum 300 is provided with a row of receiver lift fins 362 and a row of donor lift fins 364. The receiver lift fins 362 and donor lift fins 364 are used to load and unload the thermal print media 32, and the dye donor material 36. Media guide 138 feed media into the drum 300. Low level vacuum assists in loading and unloading the thermal print media 32, and the dye donor material 36.

Figure 6A:
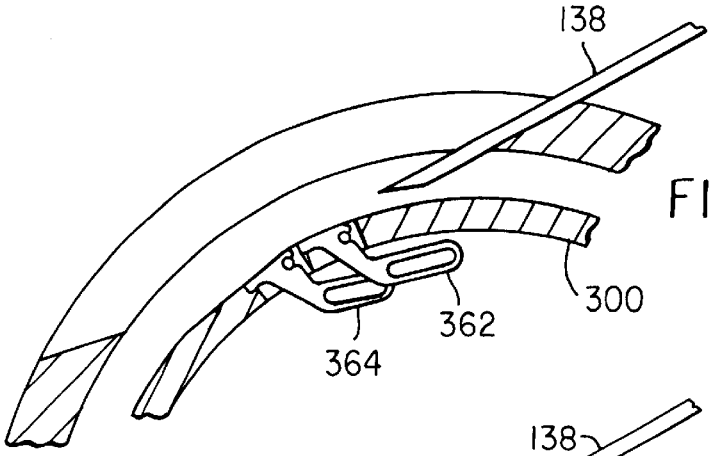
FIGS. 6*a*–6*d* are cross sectional views of a vacuum imaging drum, according to the present invention showing loading of thermal media on the drum.
Figure 6B:
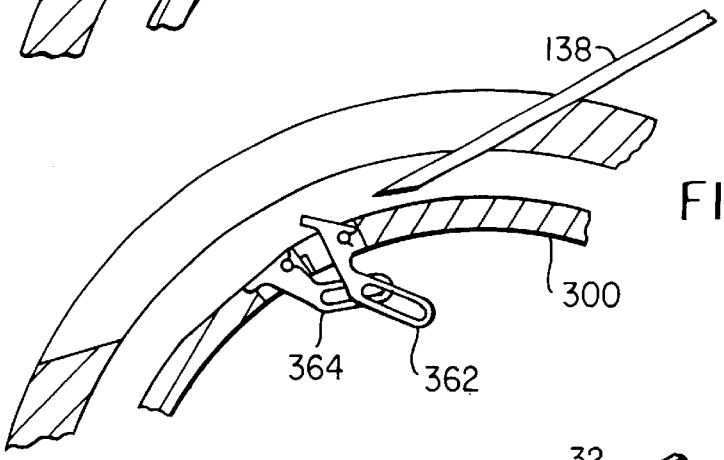
Figure 6C:
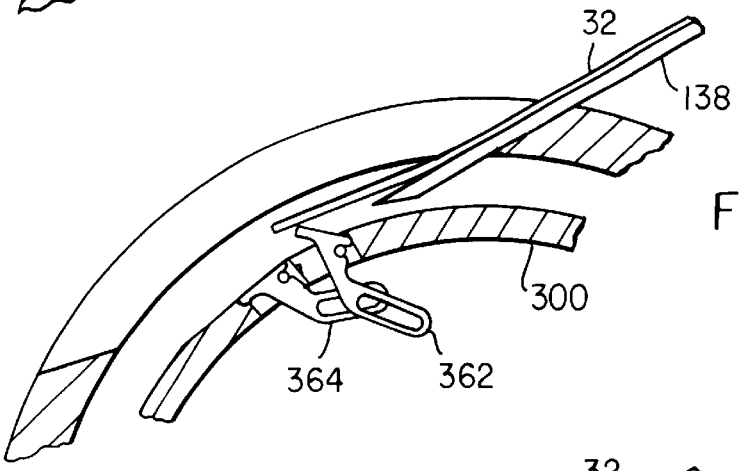

In the unactuated position or writing position the receiver lift fins 362 and donor lift fins 364 lie smooth with the vacuum imaging drum 300 surface, shown in FIG. 6*a*. When actuated, the receiver lift fins 362 and donor lift fins 364 provide a ramp for both the thermal print media 32, and the dye donor material 36. FIGS. 6*a*–6*e* and 7*a*–7*d* illustrate the thermal print media 32 sheet loading process. The low level vacuum keeps the lead edge from being drawn down prematurely. In FIG. 6*b*, the receiver lift fins 362 are extended to allow the lead edge of a thermal print media 32 to feed to a position just past receiver lift fins 362 when the lead edge of the thermal print media 32 or dye donor material 36 is moved up to the vacuum imaging drum 300. If the thermal print media 32 or dye donor material 36 were not lifted from the surface of the vacuum imaging drum 300 for loading, or if the vacuum levels were too high, vacuum force would grab the lead edge of the media as soon as it neared the vacuum ports. This would prevent the thermal print media 32 or dye donor material 36 from being loaded with its lead edge in the desired position. Thus, the lift fins provide a ramp that allows the lead edge of the thermal print media 32 or dye donor material 36 to move forward, past these vacuum ports with a low vacuum being applied.

Figure 6D:
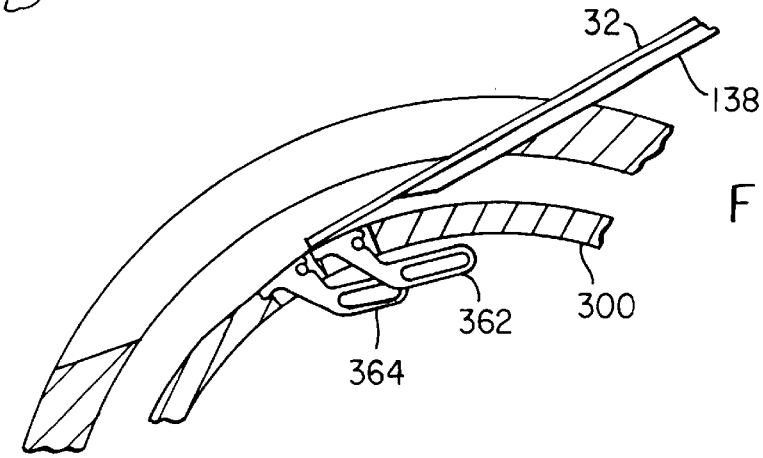

Once the lead edge of the thermal print media 32 is at the intended position, the receiver lift fins 362 recede as shown in FIG. 6*d*. Vacuum force then grips the lead edge of the thermal print media 32 and effectively locks it into position against the vacuum imaging drum 300. The vacuum imaging drum 300 then rotates to pull the rest of the thermal print media 32 forward and feed it onto the vacuum imaging drum 300.

Figure 7A:
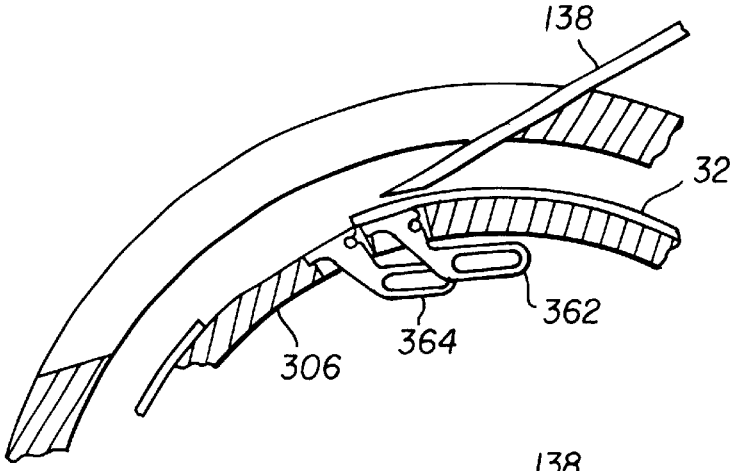
FIGS. 7*a*–7*d* are cross sectional views of a vacuum imaging drum, according to the present invention showing loading of dye donor material over the thermal media.
Figure 7B:
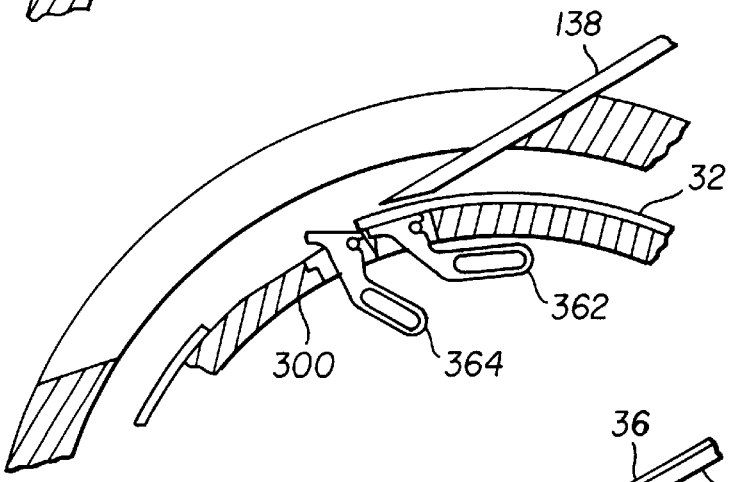
Figure 7C:
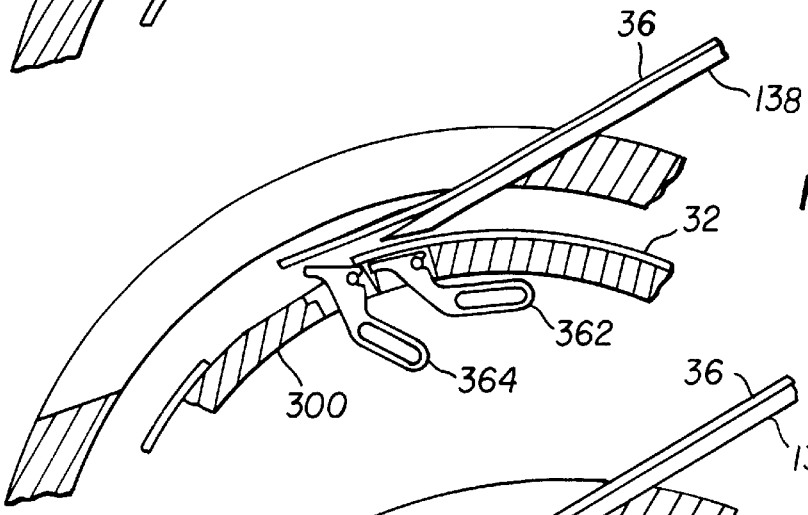
Figure 7D:
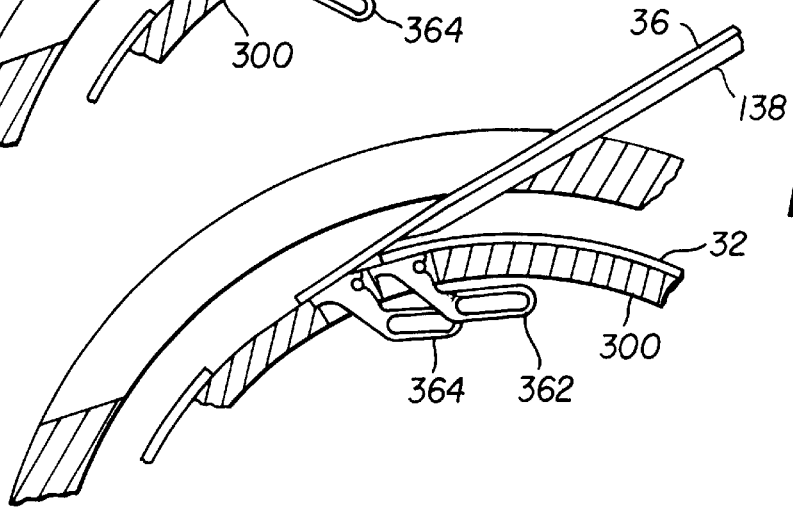

The donor lift fins 364 FIGS. 7*a*–7*d* show a similar operation for leading dye donor material 36 onto the vacuum imaging drum 300. In FIG. 7*b* the lift fins are extended to allow the dye donor material 36 lead edge to feed to a position just past the donor lift fins 364, shown in FIG. 7*c*, at a low vacuum level. Once the lead edge of the dye donor material 36 is at the intended position, the donor lift fins 364 recedes as shown in FIG. 7*d*. Vacuum force then grips the lead edge of the dye donor material 36 and effectively locks it into position against the vacuum imaging drum 300. The vacuum level is then increase to full vacuum level to hold the thermal print media 32 and dye donor material 36 in place as the vacuum imaging drum 300 spins at imaging speeds.

Figure 8A:
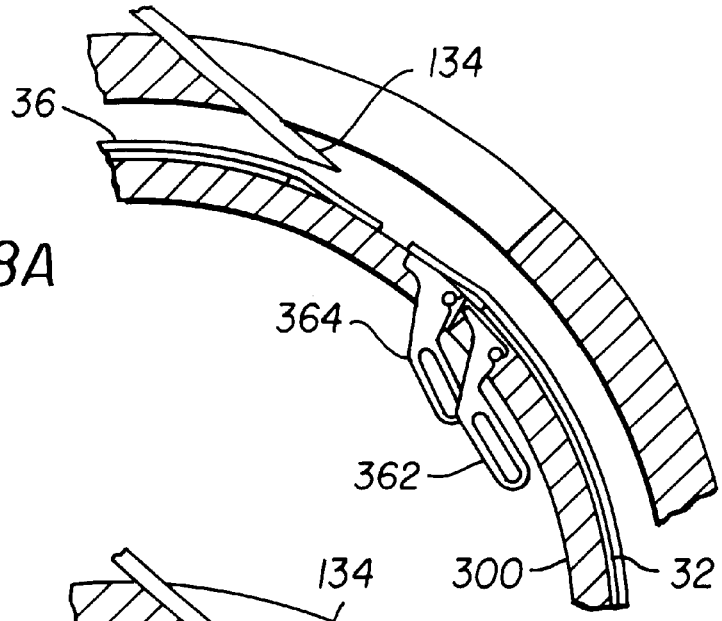
FIGS. 8*a*–8*c* are cross sectional views of a vacuum imaging drum showing removal of the donor from the drum.
Figure 8B:
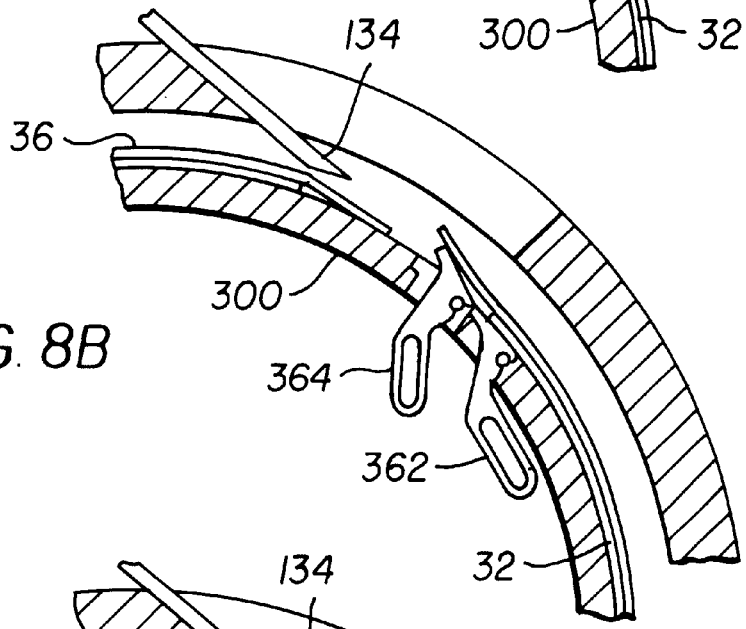
Figure 8C:
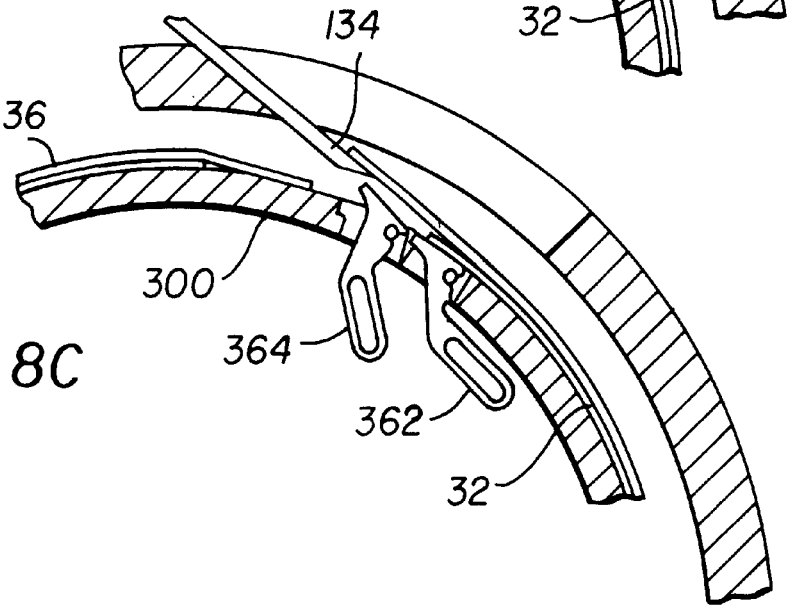

Referring to FIGS. 8*a*–8*c*, an externally mounted fixed or articulated donor skive 134 is provided for dye donor material 36 unloading from vacuum imaging drum 300. FIGS. 8*a*–8*d* show the sequence of steps for unloading the dye donor material 36 from the vacuum imaging drum 300 surface. For this activity, the vacuum is reduced to a lower level vacuum to assist the donor lift fins 364 in raising the lead edge of the dye donor material 36 to the skive, which acts as a ramp for guiding the dye donor material 36 to donor waste bin 18. Because the donor skive 134 is slotted, the donor lift fins 364 pass through the donor skive 134. The dye donor material 36, however, moves onto the surface of the skive.

Figure 9A:
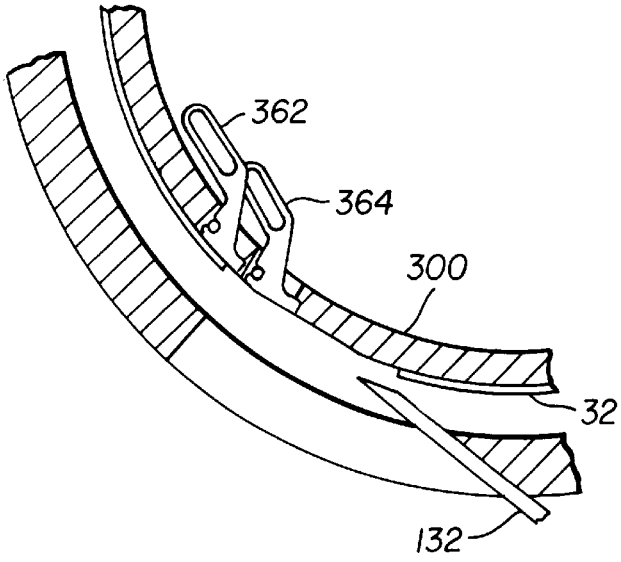
FIGS. 9*a*–9*c* are cross sectional views of a vacuum imaging drum, according to the present invention showing removal of thermal media form the drum.
Figure 9B:
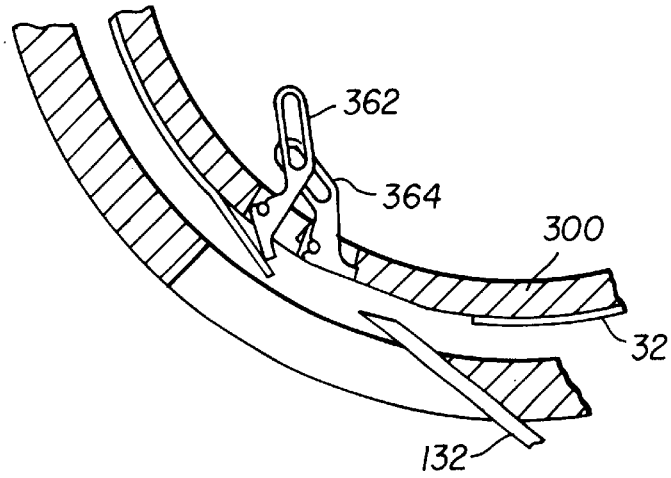
Figure 9C:
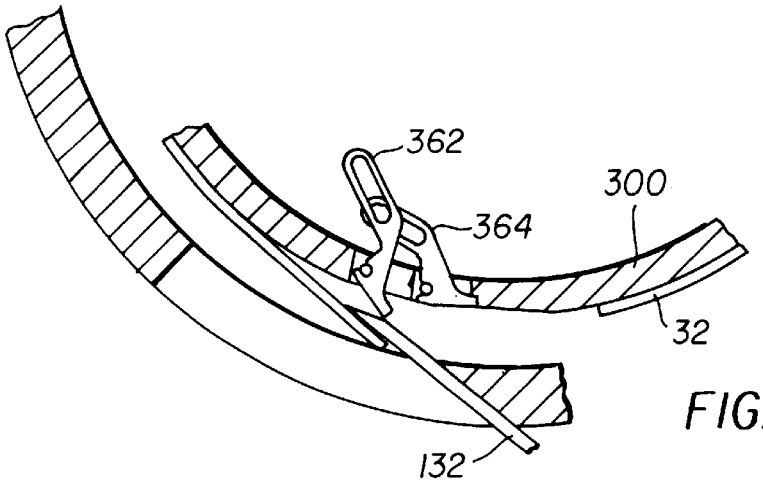

As shown in FIGS. 9*a*–9*c*, a second externally mounted fixed or articulated thermal print skive 132 is provided for removing the thermal print media 32 in a manner similar to the operation of donor skive 134. FIGS. 9*a*–9*c* show the sequence of steps for unloading thermal print media 32 from the vacuum imaging drum 300 surface at the low level vacuum to the output tray 22.

The invention has been described with reference to the preferred embodiment thereof. However, it will be appreciated that variations and modifications can be effected within the scope of the invention as described herein above and as defined in the appended claims by a person of ordinary skill in the art without departing from the scope of the invention. For example, the invention is applicable to any drum. Also, the dye donor may have dye, pigments, or other material, which is transferred to the thermal print media. Thermal print media is equivalent to paper, films, plates, and other material capable of accepting or producing an image. This invention could be used in other applications such as a single sheet vacuum imaging drum, vacuum drum plate writers or other vacuum drum imaging apparatus. This invention could also be used to vary the vacuum level to load different types of media with different physical properties, such as beam strength or size. It is also possible to vary vacuum levels by porting of the vacuum system.

PARTS LIST

10. Image processing apparatus
12. Image processor housing
14. Image processor door
16. Donor ejection chute
18. Donor waste bin
20. Media stop
22. Output tray
32. Thermal print media
33. Alternate thermal print media
34. Dye donor roll material
36. Dye donor material
50*a*. Lower sheet material tray
50*b*. Upper sheet material tray
52*a*. Lower media lift cam
52*b*. Upper media lift cam
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
132. Thermal print skive
134. Donor skive
138. Media guide
180. Color binding assembly.
182. Media entrance door
184. Media exit door
186. Machine device controller
188. Electrical lines
200. Lathe bed scanning subsystem
202. Lathe bed scanning frame

204. Entrance passageway
206. Rear translation bearing rod
208. Front translation bearing rod
220. Translation stage member
224. Vacuum blower
250. Lead screw
252. Threaded shaft
254. Lead screw drive nut
258. Linear drive motor
260. Axial load magnets
260*a*. Axial load magnet
260*b*. Axial load magnet
262. Circular-shaped boss
264. Ball bearing
270. Hollowed-out center portion
272. Radial bearing
300. Vacuum imaging drum
301. Axis of rotation
302. Vacuum drum housing
304. Hollowed out interior portion
306. Vacuum hole
308. Vacuum end plate
310. Drive end plate
312. Drive spindle
318. Vacuum spindle
320. Central vacuum opening
332. Vacuum grooves
362. Receiver lift fin
364. Donor lift fin
400. Laser assembly
402. Lasers diode
404. Fiber optic cables
406. Distribution block
500. Printhead

What is claimed is:

1. An image processing apparatus for writing images to a thermal print media comprising:

a vacuum imaging drum for supporting said thermal media;

a printhead which writes said thermal images to said thermal media;

a lead screw for moving said printhead relative to said vacuum imaging drum;

a motor for rotating said vacuum imaging drum;

a variable vacuum blower for supplying vacuum to an interior portion of said vacuum imaging drum for holding said thermal print media on a surface of said drum; and a controller for changing a speed of said vacuum blower to vary said vacuum in said vacuum imaging drum.

2. An image processing apparatus according to claim 1, wherein said vacuum is reduced for loading said thermal print media.

3. An image processing apparatus according to claim 1, wherein said vacuum is reduced for unloading said thermal print media.

4. An image processing apparatus according to claim 1, wherein said vacuum is increased at high vacuum imaging drum rotational speed.

5. An image processing apparatus according to claim 1, wherein said controller changes said speed of said vacuum blower by pulse width modulation of a DC voltage level to said vacuum blower.

6. An image processing apparatus according to claim 1, wherein said thermal print media is covered by a dye donor material.

7. An image processing apparatus according to claim 1, wherein said image processing apparatus is a laser thermal printer.

8. An image processing apparatus according to claim 1, wherein a dye donor material overlays said thermal print media and said printhead writes an image to said thermal print media by transferring from said dye donor material to said thermal print media.

9. A method for loading and unloading media from a vacuum imaging drum comprising the steps of:

creating a first vacuum level in said vacuum imaging drum;

rotating said vacuum imaging drum at a first rotational speed;

loading said media on a surface of said vacuum imaging drum wherein said media is held on said surface by vacuum holes connecting an interior of said vacuum imaging drum to said surface;

establishing a second vacuum level in said vacuum imaging drum wherein said second vacuum level is higher than said first vacuum level; and rotating said vacuum imaging drum at a second rotational speed wherein said second rotational speed is greater than said first rotational speed.

10. A method as in claim 9 comprising the additional steps of:

slowing said vacuum imaging drum to said first rotational speed;

slowing said vacuuming imaging drum to said first rotational speed; and unloading said media.

* * * * *